US005791076A

United States Patent [19]

Gailliard

[11] Patent Number: 5,791,076

[45] Date of Patent: Aug. 11, 1998

[54] BADGE HOLDER APPARATUS, AND METHODS OF CONSTRUCTING AND UTILIZING SAME

[76] Inventor: A. Carlos Gailliard, 15416 14th St., Detroit, Mich. 48238

[21] Appl. No.: 725,357

[22] Filed: Oct. 3, 1996

[51] Int. Cl.[6] ..... A44C 3/00

[52] U.S. Cl. ..... 40/1.5; 40/665; 403/23; 403/291; 63/4

[58] Field of Search ..... 40/1.5, 1.6, 665; 63/4, 21, 23; 403/23, 187, 291

[56] References Cited

U.S. PATENT DOCUMENTS

| | | | |
|---|---|---|---|
| 813,624 | 2/1906 | Doran | 40/1.5 |
| 1,298,273 | 3/1919 | Auld . | |
| 2,402,956 | 7/1946 | Fyfe | 63/23 X |
| 2,613,466 | 10/1952 | Bowder | 40/1.6 X |
| 3,193,956 | 7/1965 | Przybysiski | 40/1.5 |
| 3,212,204 | 10/1965 | Smith | 40/1.5 |
| 4,137,657 | 2/1979 | Wardle | 40/1.5 |
| 4,276,757 | 7/1981 | Boening | 63/23 X |
| 4,459,772 | 7/1984 | Kanzelberger | 40/1.5 X |

OTHER PUBLICATIONS

Gall's Inc. Catalog 95G, c 195, front cover + inside front cover + pp. 194, 206, 208.

*Primary Examiner*—Brian K. Green

*Attorney, Agent, or Firm*—Weiner, Carrier, Burt & Esser, P.C.; William F. Esser; Irving M. Weiner

[57] ABSTRACT

A badge holder apparatus for displaying information pertaining to the wearer's official position, comprising a first backing member to which a badge selectively attaches; a second backing member which is connected to the first backing member; a necklace member which is operably associated with the second backing member; a first plate member which is disposed along an exposed surface of the second backing member and having information printed thereon; and wherein the first backing member and the second backing member are substantially rigid.

10 Claims, 1 Drawing Sheet

FIG 1
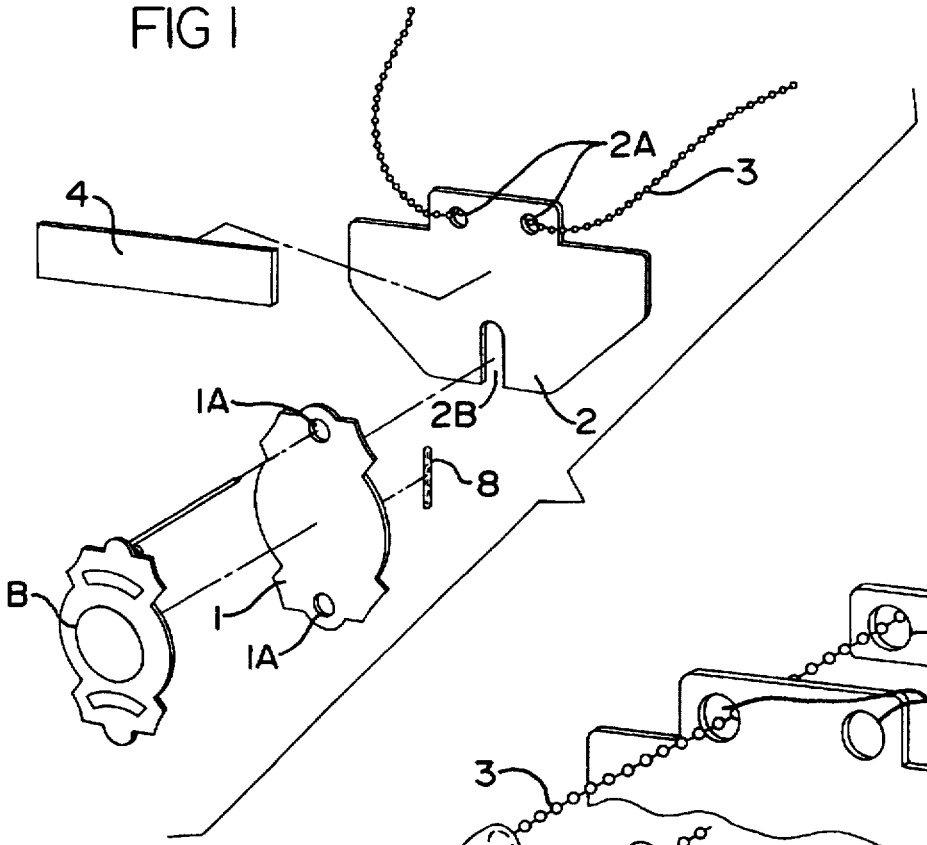
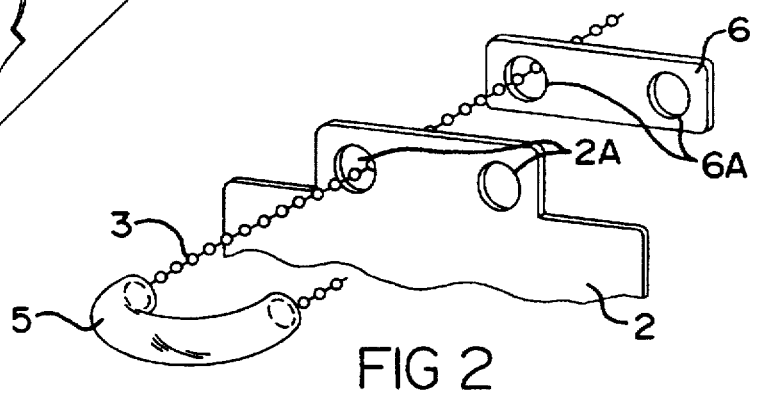
FIG 2
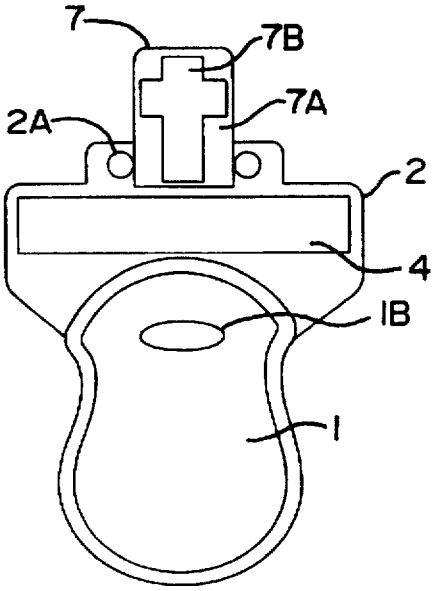
FIG 3
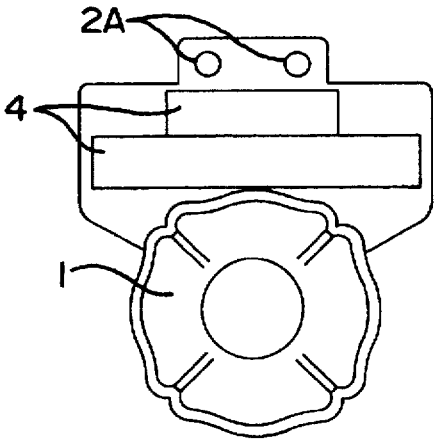
FIG 4

BADGE HOLDER APPARATUS, AND METHODS OF CONSTRUCTING AND UTILIZING SAME

BACKGROUND OF THE INVENTION

1. Field of Invention

This invention relates to an apparatus for suspending a badge around a person's neck, and particularly to a badge apparatus which identifies officer rank and which securely and stably suspends from a necklace chain.

2. The Relevant Art

There are known badges and holders therefor. For example, Gall's Inc. supplies badge holders for clipping to a belt or for suspension from a necklace.

Auld U.S. Pat. No. 1,298,273 discloses a workman's photographic identification badge.

Wardle U.S. Pat. No. 4,137,657 discloses a shield and award designation mounting device having a mounting plate.

Burns U.S. Pat. No. 3,054,201 discloses an identification badge with a detachable clip for affixing to a person.

Coleman U.S. Pat. No. 2,902,782 discloses a nameplate for designating personal information or affiliation.

The above-discussed references, however, fail to disclose or otherwise suggest a badge assembly which allows for secure and stable attachment to the user and which clearly displays the badge as well as other information associated therewith.

SUMMARY OF THE INVENTION

The present invention overcomes the above-discussed limitations and shortcomings of known badge holders/attachments and satisfies a significant need for a badge holding device which displays the badge as well as information pertaining to the person's title and/or organizational affiliation.

According to the invention, there is provided a badge holder comprising a first backing member having a means for attaching a badge thereto; a second backing member which is connected to the first backing member; a necklace member which is slidingly engaged with the second backing member; wherein the first and second backing members are substantially rigid; and a first plate member which is disposed along an exposed surface of the second backing member and having printing thereon signifying rank and/or affiliation.

In one preferred embodiment, the badge holder includes a tubing member within which the necklace member is inserted for stability and durability.

A method of making the present invention preferably comprises the steps of first punching holes in and/or otherwise working the first backing member and the second backing member so that a badge and the necklace member may suitably connect thereto, respectively. Next, one or both of the backing members are suitably cut to substantially conform to a badge and/or to other identification requirements. The first plate member is engraved so that the title or rank of the person appears thereon. The first backing member is then adhered to the second backing member. The first plate member is then secured to the front surface of the second backing member above the first backing member. The necklace member is then inserted through the apertures of the second backing member so that the badge holder slidingly engages therewith. Thereafter, a badge may be connected to the first backing member via the apertures engaging with the pin assembly of the badge.

It is an object of the invention to provide a badge holder which allows for secure attachment of a badge thereto.

Another object of the invention is to provide such a badge holder which prominently displays a badge as well as the wearer's rank and/or organization.

Still another object of the invention is to provide a badge holder to which either pin-back badges or money clip badges attach.

It is another object of the invention to provide a badge holder which is not adversely affected by its connection to a metal necklace.

Other objects, advantages and salient features of the present invention will become apparent from the following detailed description, which, when taken in conjunction with the annexed drawings, disclose preferred embodiments of the present invention.

BRIEF DESCRIPTION OF THE DRAWINGS

FIG. 1 is an exploded perspective view of a preferred embodiment of the present invention.

FIG. 2 is an exploded perspective partial view of another preferred embodiment of the present invention.

FIG. 3 is a front elevational view of a preferred embodiment of the present invention.

FIG. 4 is a front elevational view of a preferred embodiment of the present invention.

DETAILED DESCRIPTION OF THE PREFERRED EMBODIMENTS

Referring to FIGS. 1–4, there is shown a badge holder apparatus according to the present invention, comprising first backing member 1, second backing member 2, necklace member 3 and plate member 4. The present invention is preferably comprised from a sturdy and rigid material so that a variety of information may be prominently displayed therefrom and that a badge will not substantially adversely affect it even during prolonged use.

Badge B is adapted to attach to first backing member 1, as shown in FIG. 1. First backing member 1 is preferably sized and dimensioned so that its outline substantially conforms to the outline of the corresponding badge B. In a preferred embodiment of the present invention, first backing member 1, second backing member 2, and plate member 4 are cut from a rigid sheet of plastic or from a composite of a number of plastic sheets. The thickness of each are preferably sized so that each may be cut and/or pierced by hand tools. One or more apertures 1A are preferably defined through first backing member 1 so that badge B may connect thereto. Two apertures, defined at substantially opposite ends of first backing member 1, may be punched through first backing member 1 for receiving a pin-back type badge (FIG. 1). Alternatively, a slot 1B (FIG. 3) may be bored through first backing member 1 for receiving a badge having a money clip attaching means.

Second backing member 2 is adapted to connect first backing member 1 to necklace member 3. As shown in FIGS. 1, 3 and 4, the upper portion of first backing member 1 preferably but not necessarily adheres to a lower portion of second backing member 2. First backing member 1 is preferably but not necessarily adhered to second backing member 2 through use of an adhesive, by adhering a back surface of first backing member 1 to a front surface of second backing member 2. Alternatively, first backing member 1 and second backing member 2 are attached by other means. Slot 2B is preferably cut into a lower portion of second backing member 2 so that the pin from badge B may extend therethrough when badge B is connected to first backing member 1.

Apertures 2A are defined along an upper portion of second backing member 1 so that necklace member 3 may connect thereto. As shown in FIGS. 1–4, apertures 2A are substantially longitudinally aligned so that when second backing member 2 is suspended from necklace member 3 by being inserted through apertures 2A, second backing member 2 is suspended substantially evenly.

The upper portion of second backing member 2 is preferably dimensioned for displaying information relating to the rank and/or organization of the user, as will be explained below. In a preferred embodiment of the present invention, the upper portion of second backing member 2 is substantially rectangular. Alternatively, the upper portion of second backing member 2 has another shape.

The lower portion of second backing member 2 includes side edges which are preferably but not necessarily substantially inwardly tapered so that, when assembled, the present invention provides a professional appearance by substantially appearing as a ribbon or award decoration. Alternatively, second backing member 2 is substantially rectangular or has another shape.

Necklace member 3 is preferably substantially bendable for convenient suspension from a person's neck. In a preferred embodiment of the present invention, necklace member 3 comprises a ball type chain having wire segments interconnecting the ball members together. In a second preferred embodiment, necklace member 3 comprises a chain.

The preferred embodiments of the present invention preferably includes one or more plate members 4 for displaying information regarding the user's rank and or organization with which the user is affiliated. Plate member 4 is preferably but not necessarily adhered along the upper surface of second backing member 2 above first backing member 1, as shown in FIGS. 3 and 4. In a preferred embodiment of the present invention, plate member 4 is attached along the upper surface of second backing member 2 by an adhesive.

Information, such as the wearer's title, department or organization, is preferably permanently printed on plate member 4, such as through use of an etching or engraving process. Plate member 4 is preferably but not necessarily constructed from a multiple sheet plastic composite wherein the sheets are of different colors, so that when print information is etched or engraved into the top layer, the bottom layer is exposed, thereby clearing displaying the printed information due to the contrasting colors of the plastic sheet layers.

As shown in FIGS. 1 and 3, a single plate member 4 is adhered to second backing member 2. Alternatively, more than one plate member is attached to second backing member 2 substantially adjacent each other, as shown in FIG. 4.

Over an extended period of time, metal necklace members tend to wear into the edges which define the apertures of badge holders through which the necklace is inserted. In addition, badge holders which are suspended from necklace members tend to slide therealong, which creates an audible sound and which eventually allows the clasp member of the necklace to be displaced from its desired position directly behind the wearer's neck. As a result, an embodiment of the present invention preferably includes flexible tubing member 5 which is inserted through both apertures 2A of second backing member 2 and into which necklace member 3 is inserted (FIG. 5). End portions of tubing 5 preferably extend from the same surface of second backing member 2. Tubing 5 is preferably but not necessarily constructed from a resilient and flexible material so that wear due to frictional contact between necklace member 3 and tubing 5 is substantially eliminated. In one embodiment of the present invention, tubing 5 is constructed from a plastic or rubber composition, such as a plastic polyethylene or urethane composition or a rubber elastomer composition. It is understood that the central portion of tubing 5 may be disposed along the front (FIG. 2) or back surface of second backing member 2.

In addition to preventing necklace member 3 from wearing into the aperture edges of second backing member 2, tubing member 5 also substantially prevents the present invention from sliding along necklace member 3. Backing member 6 may be secured along the back side of second backing member 2 to provide stability to the upper portion thereof.

The present invention is adapted for attachment to virtually any type of badge. In order to ensure a secure, substantially rattle-free engagement between any badge and first backing member 1, the present invention may preferably include padding 8 which is disposed along the back surface of first backing member 1 between apertures 1A (FIG. 1). In this way, padding 8 contacts the badge pin or clip so that any movement between badge B and first backing member 1 is substantially eliminated. Padding 8 may be preferably but not necessarily connected to the back surface of first backing member 1 by an adhesive.

According to the preferred embodiments of the present invention, the badge holder displays information pertaining to the wearer's rank or organization which others, including literate and illiterate alike, may quickly identify. An embodiment of the present invention preferably but not necessarily includes insignia means 7 for indicating a mark or emblem corresponding to the wearer's title, rank, department and/or organization with which the wearer is affiliated. As shown in FIG. 3, the insignia means preferably comprises insignia backing member 7A which is attached along the exposed surface of second backing member 2, and emblem member 7B which is attached to the exposed surface of insignia backing member 7A. Insignia backing member 7A is preferably attached to the upper surface of second backing member 2 using an adhesive, and is preferably sized and dimensioned for conformance with the dimensions of emblem member 7B. Emblem member 7B may preferably attach to insignia backing member 7A using an adhesive.

It is noted that emblem member 7B may be virtually any symbol or mark which clearly identifies information pertaining to the wearer of the present invention, so that virtually anyone may quickly determine this information. For example, emblem member 7B may comprise a cross (indicating that the wearer is a priest, chaplain or minister, as shown in FIG. 3) or a set of bars (indicating a particular rank of the wearer).

The method of making the present badge holder, such as from a kit, preferably but not necessarily comprises the steps of first working first backing member 1, second backing member 2, plate member 4 and insignia backing member 7A by cutting, piercing or otherwise forming the backing members according to the nature and dimensions of badge B and according to the desires of the wearer. Plate member 4 is etched, engraved or otherwise worked so that the desired information is clearly displayed thereon. Next, first backing member 1, insignia backing member 7A and plate member (s) 4 are secured to second backing member 2, emblem member 7B is secured to backing member 7A, and padding member 8 is secured to first backing member 1. Then tubing member 3 is connected to apertures 2A of second backing member 2 by inserting the end portions of tubing member 3 into apertures 2A. Necklace member 3 is then inserted through tubing member 3 so that it is connected to second backing member 2. Thereafter, a badge B or other article may be secured to first backing member 1 via apertures 1A/slot 1B.

Although there have been described what are at present considered to be the preferred embodiments of the present invention, it will be understood that the invention can be embodied in other specific forms without departing from the spirit or essential characteristics thereof.

For example, instead of having a badge attach to first backing member 1, a different article which designates affiliation with an agency or organization or which designates an award or some other recognized status may be attached to first backing member 1 (FIG. 4). Alternatively, first backing member 1 may itself be cut, carved or otherwise worked in order to indicate affiliation or other recognized status.

The described embodiments are, therefore, to be considered in all aspects as illustrative, and not restrictive. The scope of the invention is indicated by the appended claims rather than the foregoing description.

I claim:

1. A badge holding apparatus, comprising:

a first backing member having a means for attaching a badge thereto;

a second backing member connected to said first backing member;

a necklace member which is operably connected with said second backing member;

said first backing member and said second backing member are substantially rigid; and a first plate member which is disposed along a front surface of said second backing member and having printing thereon;

a tubing member having end portions which are connected to said second backing member; and wherein a portion of said necklace member is located within said tubing member.

2. An apparatus as recited in claim 1 wherein:

said tubing member is bent so that each of said end portions thereof extends from a same surface of said second backing member.

3. An apparatus as recited in claim 2, further including:

a support member disposed along a back surface of said second backing member, said support member having apertures defined therethrough for receiving said end portions of said tubing member.

4. An apparatus as recited in claim 1, wherein:

said tubing member is substantially flexible.

5. An apparatus as recited in claim 1, further including:

insignia means, disposed along said front surface of said second backing member, for symbolically identifying information corresponding to a user of said apparatus.

6. An apparatus as recited in claim 1, further including:

a second plate member disposed along said front surface of said second backing member proximally to said first plate member, and having printing thereon.

7. A badge holding apparatus, comprising:

a first backing member having a means for attaching a badge thereto;

a second backing member connected to said first backing member;

a necklace member which is operably associated with said second backing member;

said first backing member and said second backing member are substantially rigid; and a first plate member attached directly to a front surface of said second backing member and having printing thereon; and said badge attaching means includes an aperture disposed laterally through said first backing member.

8. A badge holder kit, comprising:

a first backing member;

a second backing member;

wherein said first backing member and said second backing member are substantially rigid and substantially cuttable;

said first backing member is adapted for adherence to said second backing member;

said second backing member includes at least one aperture;

a necklace member which is insertible through said at least one aperture of said second backing member;

a first plate member which is adapted for adherence along said second backing member;

said second backing member includes a plurality of apertures defined therethrough;

said kit further includes a tubing member which is insertible through said apertures of said second backing member; and said necklace member is insertible through said tubing member.

9. A kit as recited in claim 8, wherein:

said tubing member is substantially flexible so that end portions thereof extend from a same side of said second backing member.

10. A kit as recited in claim 8, further including:

a symbol member which symbolically communicates information pertaining to the user.

* * * * *